US007994891B2

(12) United States Patent
Wedley

(10) Patent No.: US 7,994,891 B2
(45) Date of Patent: Aug. 9, 2011

(54) STACKED INDUCTIVE DEVICE ASSEMBLIES AND METHODS

(75) Inventor: Timothy Craig Wedley, Tuam (IE)

(73) Assignee: Pulse Engineering, Inc., San Diego, CA (US)

( * ) Notice: Subject to any disclaimer, the term of this patent is extended or adjusted under 35 U.S.C. 154(b) by 0 days.

(21) Appl. No.: 12/572,177

(22) Filed: Oct. 1, 2009

(65) Prior Publication Data

US 2010/0026441 A1 Feb. 4, 2010

Related U.S. Application Data

(62) Division of application No. 11/203,042, filed on Aug. 12, 2005, now Pat. No. 7,598,839.

(60) Provisional application No. 60/600,985, filed on Aug. 12, 2004.

(51) Int. Cl.
*H01F 27/24* (2006.01)

(52) U.S. Cl. ..... 336/212; 336/192; 336/214; 336/215

(58) Field of Classification Search ..... 336/192, 336/212, 214, 215
See application file for complete search history.

(56) References Cited

U.S. PATENT DOCUMENTS

| | | | | | |
|---|---|---|---|---|---|
| 2,418,643 | A | * | 4/1947 | Huge | 363/172 |
| 3,247,450 | A | * | 4/1966 | Medlar | 323/307 |
| 3,249,851 | A | * | 5/1966 | Medlar | 323/307 |
| 3,328,738 | A | * | 6/1967 | Broverman et al. | 336/215 |
| 3,354,417 | A | * | 11/1967 | Davis | 336/198 |
| 3,531,708 | A | * | 9/1970 | Kuba | 363/2 |
| 3,622,868 | A | * | 11/1971 | Todt | 323/250 |
| 4,146,859 | A | | 3/1979 | Quirke | |
| 4,488,136 | A | * | 12/1984 | Hansen et al. | 336/215 |
| 4,498,067 | A | | 2/1985 | Kumokawa et al. | |
| 5,182,535 | A | * | 1/1993 | Dhyanchand | 336/12 |
| 5,212,345 | A | | 5/1993 | Gutierrez | |
| 5,309,130 | A | | 5/1994 | Lint | |
| 5,351,167 | A | | 9/1994 | Wai et al. | |
| 5,534,838 | A | | 7/1996 | Lindberg | |
| 5,539,369 | A | * | 7/1996 | Selker et al. | 336/212 |
| 5,726,615 | A | | 3/1998 | Bloom | |
| 5,789,907 | A | * | 8/1998 | Casagrande | 323/335 |
| 6,005,467 | A | | 12/1999 | Abramov | |
| 6,087,920 | A | | 7/2000 | Abramov | |
| 6,087,921 | A | | 7/2000 | Morrison | |
| 6,501,362 | B1 | | 12/2002 | Hoffman et al. | |
| 6,525,638 | B2 | | 2/2003 | Oi | |
| 6,642,827 | B1 | | 11/2003 | McWilliams et al. | |
| 6,734,773 | B2 | | 5/2004 | Ackermann | |
| 7,009,482 | B2 | | 3/2006 | Kiko et al. | |
| 7,057,486 | B2 | | 6/2006 | Kiko | |
| 7,109,837 | B2 | | 9/2006 | Watts et al. | |
| 7,598,837 | B2 | * | 10/2009 | Gilmartin et al. | 336/192 |
| 2005/0046534 | A1 | | 3/2005 | Gilmartin et al. | |

* cited by examiner

*Primary Examiner* — Anh T Mai
*Assistant Examiner* — Joselito Baisa
(74) *Attorney, Agent, or Firm* — Gazdzinski & Associates, PC

(57) ABSTRACT

Improved inductive electronic apparatus and methods for manufacturing the same. In one exemplary embodiment, the apparatus comprises an inductive device module comprising N inductors and N+1 core elements. The core elements comprise ferrite core pieces that are optionally identical to one another. These core elements are stacked (e.g., in a longitudinal coaxial arrangement) such that the back of one core element associated with a first inductor provides a magnetic flux path for a second inductor. Form-less (bonded) windings are also optionally used to simplify the manufacture of the device, reduce its cost, and allow it to be made more compact (or alternatively additional functionality to be disposed therein). One variant utilizes a termination header for mating to a PCB or other assembly, while another totally avoids the use of the header by directly mating to the PCB.

20 Claims, 6 Drawing Sheets

(PART 1 OF 2)

(PART 2 OF 2)

STACKED INDUCTIVE DEVICE ASSEMBLIES AND METHODS

PRIORITY

This application is a divisional of and claims priority to co-owned U.S. patent application Ser. No. 11/203,042 entitled "STACKED INDUCTIVE DEVICE AND METHODS OF MANUFACTURING", filed Aug. 12, 2005 and issuing as U.S. Pat. No. 7,598,839 on Oct. 6, 2009, which claims priority to U.S. Provisional Patent Application Ser. No. 60/600,985 filed Aug. 12, 2004 of the same title, each of which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The present invention relates generally to electronic elements and particularly to an improved design and method of manufacturing miniature electronic components including inductive devices (e.g., inductors, "choke coils", etc.).

2. Description of Related Technology

As is well known in the art, inductive components are electronic devices which provide the property of inductance (i.e., storage of energy in a magnetic field) within an alternating current circuit. Inductors are one well-known type of inductive device, and are formed typically using one or more coils or windings which may or may not be wrapped around a magnetically permeable core. So-called "dual winding" inductors utilize two windings wrapped around a common core.

Transformers are another type of inductive component that are used to transfer energy from one alternating current (AC) circuit to another by magnetic coupling. Generally, transformers are formed by winding two or more wires around a ferrous core. One wire acts as a primary winding and conductively couples energy to and from a first circuit. Another wire, also wound around the core so as to be magnetically coupled with the first wire, acts as a secondary winding and conductively couples energy to and from a second circuit. AC energy applied to the primary windings causes AC energy in the secondary windings and vice versa. A transformer may be used to transform between voltage magnitudes and current magnitudes, to create a phase shift, and to transform between impedance levels.

Ferrite-cored inductors and transformers are commonly used in modern broadband telecommunications circuits to include ISDN (integrated services digital network) transceivers, DSL (digital subscriber line) modems and cable modems. These devices provide any number of functions including shielding, control of longitudinal inductance (leakage), and impedance matching and safety isolation between broadband communication devices and the communication lines to which they are connected. Ferrite-core inductive device technology is driven by the need to provide miniaturization while at the same time meeting performance specifications set by chip-set manufactures and standards bodies such as the ITU-T. For example, in DSL modems, micro-miniature transformers are desired that can allow a DSL signal to pass through while introducing a minimal THD (total harmonic distortion) over the DSL signal bandwidth. As another example, dual-winding inductors can be used in telephone line filters to provide shielding and high longitudinal inductance (high leakage).

"Shaped" Devices

A common prior art ferrite-cored inductive device is known as the EP-core device. Other similar well-know devices include inter alia so-called EF, EE, ER, and RM devices. FIG. 1 illustrates a prior art EP transformer arrangement, and illustrates certain aspects of the manufacturing process therefore. The EP core of the device 100 of FIG. 1 is formed from two EP-core half-pieces 104, 106, each having a truncated semi-circular channel 108 formed therein and a center post element 110, each also being formed from a magnetically permeable material such as a ferrous compound. As shown in FIG. 1, each of the EP-core half-pieces 104, 106 are mated to form an effectively continuous magnetically permeable "shell" around the windings 112, the latter which are wound around a spool-shaped bobbin 109 which is received on the center post element 110. The precision gap in ground on the ferrite post 110 can be engineered to adjust the transfer function of the transformer to meet certain design requirements. When the EP core device is assembled, the windings 112 wrapped around the bobbin 109 also become wrapped around the center post element 110. This causes magnetic flux to flow through the EP core pieces when an alternating current is applied to the windings. Once the device is assembled, the outer portion of the EP cores self-enclose the windings to provide a high degree of magnetic shielding. The ferrous material in the core is engineered to provide a given flux density over a specified frequency range and temperature range.

The bobbin 109 includes a terminal array 114 generally with the windings 112 penetrating through the truncated portions 116 of the half-pieces 104, 106, the terminal array 114 being mated to a printed circuit board (PCB) or other assembly. Margin tape (not shown) may also be applied atop the outer portions of the outer winding 112 for additional electrical separation if desired.

For each core shape and size, various differing bobbins are available. The bobbins themselves (in addition to the other elements of the parent device) have many different characteristics; they can provide differing numbers of pins/terminations, different winding options, different final assembly techniques, surface mount versus through-hole mount, etc.

Magnet wire is commonly used to wind transformers and inductive devices (such as inductors and transformers, including the aforementioned EP-type device). Magnet wire is made of copper or other conductive material coated by a thin polymer insulating film or a combination of polymer films such as polyurethane, polyester, polyimide (aka "Kapton™"), and the like. The thickness and the composition of the film coating determine the dielectric strength capability of the wire. Magnet wire in the range of 31 to 42 AWG is most commonly used in microelectronic transformer applications, although other sizes may be used in certain applications.

The prior art EP and similar inductive devices described above have several shortcomings. A major difficulty with EP devices is the complexity of their manufacturing process, which gives rise to a higher cost. The use of a bobbin (also called a "form" or "former") increases not only the cost, but size and complexity of the final device, since the bobbin is retained within the device upon completion of the manufacturing process. The bobbin consumes space within the device which could be used for other functionality, or conversely eliminated to give the final device a smaller size and/or footprint.

Also, the EP core half pieces themselves are relatively costly to mold and produce. For example, by the time the EP transformer is assembled and tested, its volume production cost is high (currently ranging from approximately $0.50 to-$0.70). It would be desirable to produce a device having performance characteristics at least equivalent to those of an EP transformer, but at a significantly lower cost.

It will also be appreciated that prior art core configurations such as the EP core are inherently inflexible from two standpoints: (i) there is typically only one style or configuration of device that can be produced from the pre-formed core pieces (i.e., one cannot form a different or compound device from the core pieces), and (ii) the core pieces typically have some degree of asymmetry or chirality, thereby dictating their orientation. Hence, this inflexibility necessitates the manufacture and stocking of components specifically adapted for certain products/applications only.

Bonded Wire

Bonded wire is a well-established product/process that is used to produce so-called "air coils". Air coils themselves are inductors, and are typically use in RFID tags, voice coils, sensors, and the like. The materials and manufacturing equipment for producing bonded wire are commercially available from a variety of sources known to the artisan of ordinary skill.

Bonded wire is essentially an enamel-coated wire having additional coating applied (by either the wire vendor or the device manufacturer) to the outer surfaces of the enamel. During winding, the bonded wire coating may be activated (normally by heat, although other types of processes including radiation flux, chemical agents, and so forth) to cause the coated wires to stick/bond together. This approach provides certain benefits and cost economies in the context of electronic component production.

Accordingly, based on the foregoing, there is a need for an improved electronic device, and a method of manufacturing the device, that is both spatially compact and highly flexible in its implementation and configurations. Ideally, such improved device would also not require use of a bobbin or other form(er), and would utilize existing and well understood technologies (such as e.g., bonded wire) in order to simplify the manufacturing process and further reduce cost, while maintaining the desired level of electrical performance.

SUMMARY OF THE INVENTION

The foregoing needs are satisfied by the present invention which provides improved inductive apparatus and methods for manufacturing the same.

In a first aspect of the invention, an improved electronic device is disclosed. In one exemplary embodiment, the device comprises a stacked inductive device having N inductors and N+1 core elements arranged in a longitudinally stacked arrangement. Identical core elements are used in order to simplify cost. Similarly, bonded windings are used without any bobbin or similar structure in order to simplify the device and reduce cost and size.

In a second embodiment, the device comprises: at least first, second, third and fourth core elements; and at least first, second, and third windings. The first and second core pieces are arranged in a substantially parallel face-to-face orientation so as to form a first recess substantially containing the first winding. The third core element is disposed adjacent to at least the first core element in a parallel stacked arrangement, the third and first core elements forming a second recess substantially containing the second winding; and the fourth core element is disposed adjacent to at least the second core element so as to form a third recess substantially containing the third winding.

In a third embodiment, the device comprises at least three substantially identical magnetically permeable core pieces and at least two winding elements magnetically interacting therewith. In one variant, each of the core pieces is mated to only one other of the core pieces, and the at least two winding elements comprise first and second winding elements, the first winding element having a different number of turns than the second winding element.

In a second aspect of the invention, a header-less inductive device is disclosed. In one embodiment, the device comprises: a plurality of winding elements, wherein each winding element further comprises a plurality of winding ends that can be terminated; at least three magnetically permeable core elements, wherein the magnetically permeable core elements are disposed in a substantially co-axial arrangement; and means for attaching the magnetically permeable core elements to one another; wherein the plurality of winding elements each reside at least partly inside respective cavities formed by the substantially co-axial magnetically permeable core elements.

In a third aspect of the invention, a method of manufacturing the above-referenced electronic device is disclosed. In one embodiment, the method comprises: providing a plurality of core elements; providing a plurality of winding elements wherein each of the winding elements has been formed into a predetermined shape so as to comprise a substantially unitary body; and assembling the winding elements and the core elements so that the winding elements are each at least partly contained within a respective cavity formed between two of the plurality of core elements.

In a fourth aspect of the invention, an improved "direct assembly" inductive device is disclosed. In one embodiment, the device comprises a form-less inductive device as previously described, yet which mates directly with the parent assembly (e.g., PCB), thereby obviating the termination header. The free ends of the windings protrude from the device through an aperture formed in the underlying assembly. The ends are soldered to conductive pads formed on the PCB substrate.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE INVENTION

Reference is now made to the drawings wherein like numerals refer to like parts throughout.

As used herein, the term "magnetically permeable material" refers to any number of materials commonly used for forming inductive cores or similar components, including without limitation various formulations made from ferrite.

As used herein, the term "winding" refers to any type of conductor(s), irrespective of shape, cross-section, material, or number of turns, which is/are adapted to carry electrical current.

Overview

In one primary aspect, the present invention provides improved "stacked" inductive electronic apparatus and methods for producing the same. One significant benefit of the present invention is high cost efficiency for a corresponding high level of electrical performance, as well as spatial compactness (i.e., the device can be made smaller in size and/or footprint).

In effect, a compact, high performance and low-cost inductor module is provided by combining numerous cores and coils together within a single form factor. In one exemplary configuration, the core elements are purposely made identical (i.e., are the same production component, albeit not perfectly identical), thereby allowing for the purchase of larger lots of core elements (and hence allowing for a lower manufacturing cost). Form-less (i.e., bobbin-less) bonded windings are also used in one embodiment in order to further reduce device complexity, cost, and size.

The individual core elements can be arranged in a number of different way including, without limitation (i) in a face-to-face co-linear orientation; (ii) in a face-to-back or stacked collinear orientation; (iii) in an orthogonal orientation; and (iv) combinations of the foregoing.

Exemplary Apparatus

It will be recognized that while the following discussion is cast in terms of an exemplary multi-inductor device, the invention is equally applicable to other core configurations and even other types of inductive devices. Conceivably, any device having a plurality of winding turns and a magnetically permeable core (or comparable structure) may benefit from the application of the approach of the present invention. Accordingly, the following discussion of the inductive device is merely illustrative of the broader concepts.

Figure 1:
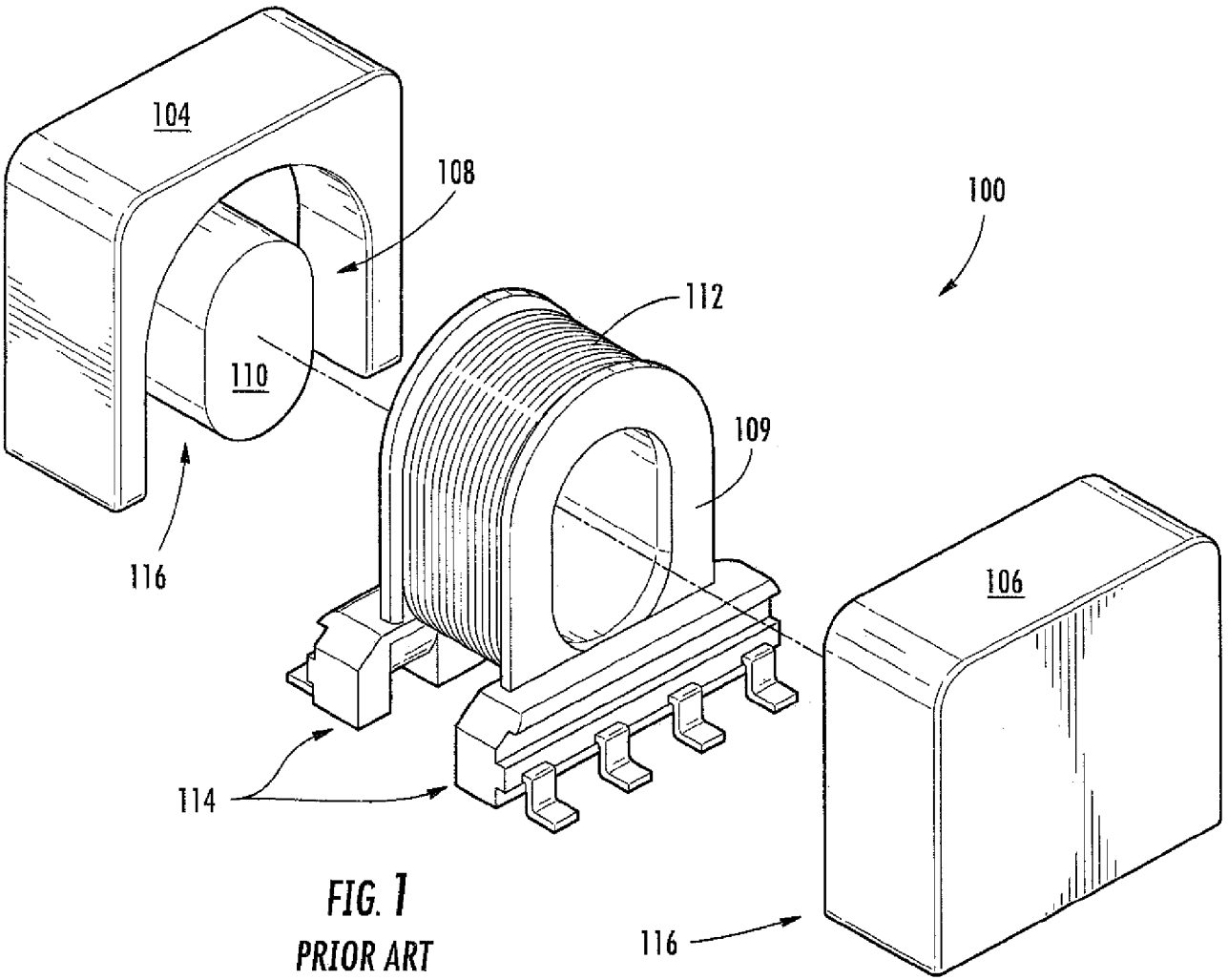
FIG. 1 PRIOR ART
FIG. 1 is an exploded perspective view of a typical prior art "EP" type inductive device.
Figure 2A:
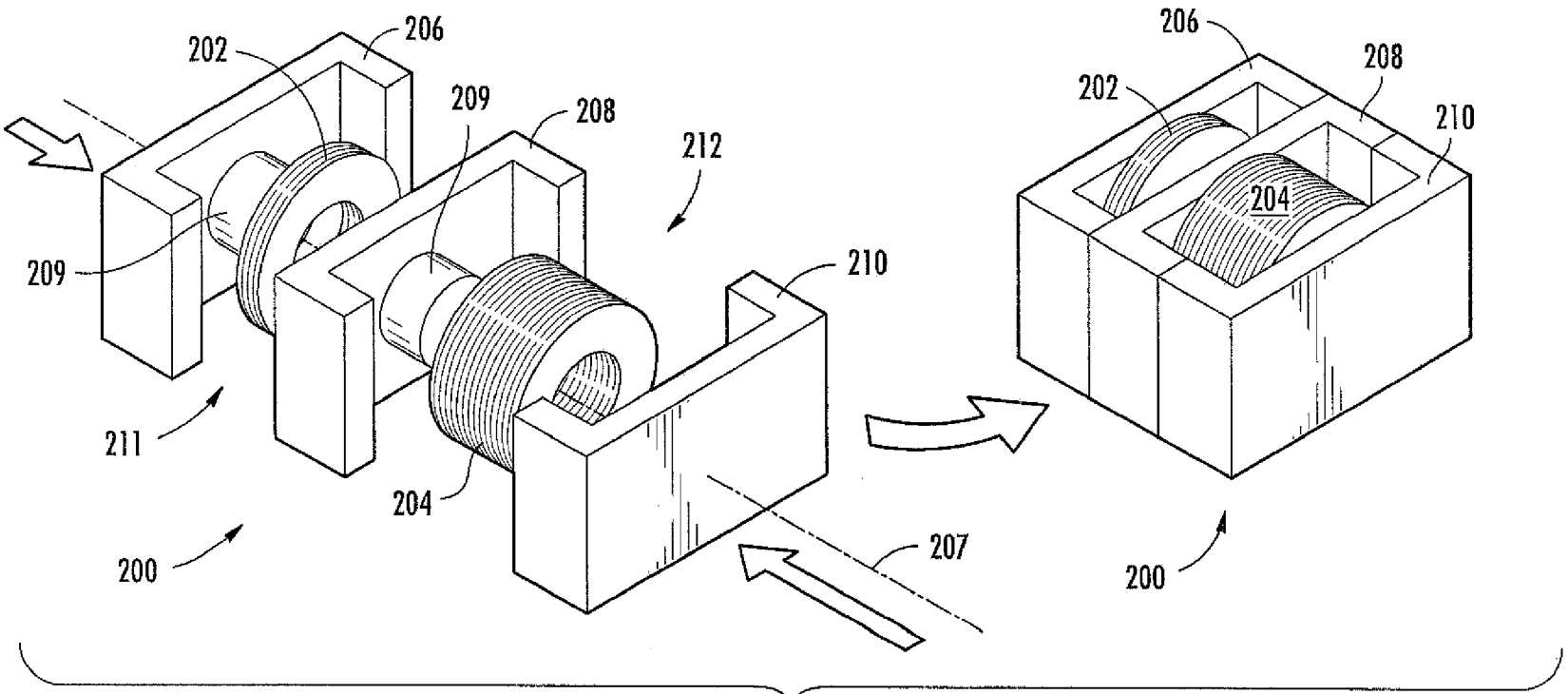
FIG. 2*a* comprises exploded and assembled perspective views of a first embodiment of a two-inductor stacked inductive device of the invention.

Referring now to FIG. 2*a*, a first exemplary embodiment of the stacked inductive device of the present invention is disclosed. As illustrated in FIG. 2*a*, the inductive device 200 comprises a first winding element 202, a second winding element 204, and first, second and third core elements 206, 208, 210 into which the winding elements 202, 204 are assembled. The device is generally held together when assembled using an adhesive or epoxy; however, it will be appreciated that other methods such as clips, frictional or interference pin/hole arrangements, etc. may be used if desired. Adhesive/epoxy has the advantages of low cost and simplicity.

The core elements are fashioned from a magnetically permeable material such as a soft ferrite or powdered iron, as is well known in the electrical arts. The manufacture and composition of such cores is well understood, and accordingly is not described further herein.

Each of the winding elements 202, 204 may comprise a single winding (single strand, bifilar, or otherwise), or alternatively may comprise multiple windings. Such multiple windings may be in the form a unitary structure (such as where the windings are bonded together, interwoven, or bifilar) or may alternatively comprise two or more substantially discrete winding elements (such as, e.g., two winding "toroids" placed immediately adjacent one another between the two core elements). The windings may also be insulated (such as by using Kapton™ polyimide or another type of insulation), comprise so-called "magnet wire", or comprise any number of different conductor configurations. For example, in one variant, the bonded wire comprises 35 AWG-42 AWG bondable wire manufactured by the Bridgeport Insulated Wire Company of Bridgeport, Conn., although other manufacturers, configurations and sizes of wire may be used. This wire comprises round copper magnet wire with a polyurethane base coating. The polyurethane base coat has a polyamide (Kapton) and self-bonding overcoat. The wire of the illustrated embodiment can be made to comply with relevant electrical standards (e.g., with the NEMA MW29-C and IEC 317-35 international standards for wire), although this is not required in any fashion.

In the exemplary embodiment, the first and second winding elements comprise "form-less" windings of the type described in co-pending and co-owned U.S. patent application Ser. No. 10/885,868 filed Jul. 6, 2004 and entitled "Form-less Electronic Device and Methods of Manufacturing" incorporated herein by reference in its entirety, although other approaches may be used as well. The form-less windings have the advantage of low cost and lack of a former or bobbin, thereby reducing their spatial profile considerably while maintaining the desired electrical performance.

While bonded wire is preferred, the device 200 may also utilize wound coils formed and coated as described generally in co-owned and co-pending U.S. patent application Ser. No. 09/661,628 filed Sep. 13, 2000 and entitled "Advanced Electronic Miniature Coil and Method of Manufacturing", which is also incorporated herein by reference in its entirety. Specifically, a Parylene coating is applied to a plurality of individual wires formed into a layer or group using for example a vapor or vacuum deposition process. Parylene is chosen for its superior properties and low cost; however, certain applications may dictate the use of other insulating materials. Such materials may be polymers such as for example fluoropolymers (e.g., Teflon, Tefzel), polyethylenes (e.g., XLPE), polyvinylchlorides (PVCs), or conceivably even elastomers. Additionally, dip or spray-on coatings may be used to form the winding elements 102, 104 of the illustrated invention.

Furthermore, as shown in FIG. 2*a*, the first and second windings 202, 204 may be heterogeneous including having a different geometry, e.g., different overall thickness (i.e., as measured longitudinally along the central axis 207 of the winding), different radius, different winding type, etc.

Figure 2B:
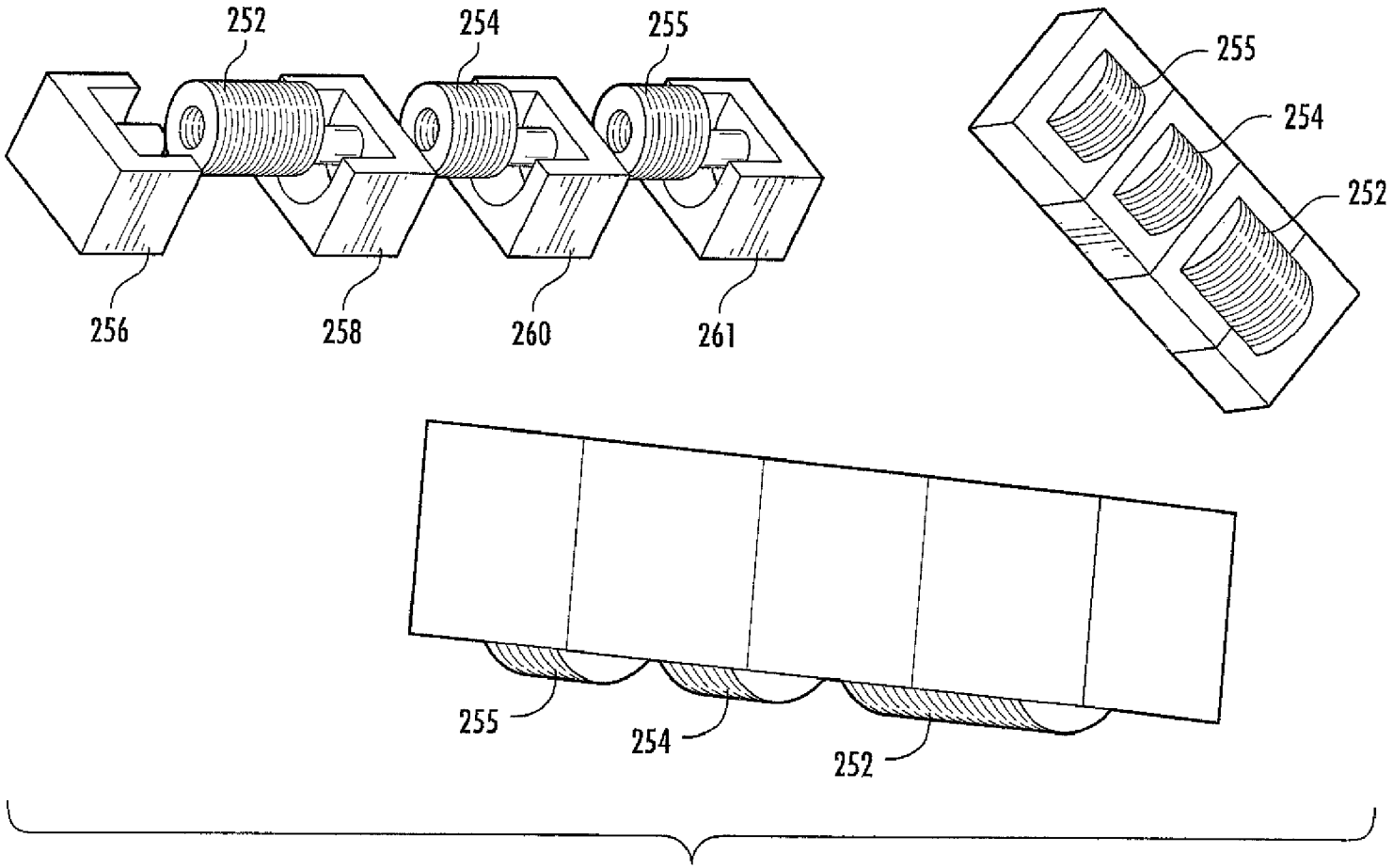
FIG. 2*b* comprises exploded and assembled perspective views of a three inductor embodiment of the stacked inductive device of the invention.

It will also be appreciated that while the embodiment of FIG. 2*a* shows windings which are substantially toroidal (i.e., donut-shaped) in form, they may also have other geometries, such as being in a substantially oval form such as is used with prior art shaped "E" cores (e.g., EP, EP-7 "tall cores", EF, EE, and RM, and even pot core) of the type well known in the art. FIG. 2*b* discussed below illustrates one exemplary alternate embodiment using an EP-type core form factor.

A significant aspect of the device 200 of FIG. 2*a* is the use of multiple inductive devices 211, 212 comprised of the core elements 206, 208, 210 and winding elements 202, 204 in a "stacked" arrangement which provide a magnetic coupling path for the first core element 206 (in the first device 211) through the second core element 208, the latter which also serves as part of the second device 212, and hence is coupled into the third core element 210. Stated mathematically, for "N" inductors, the exemplary device utilizes "N+1" core pieces.

Specifically, since inductors are DC energy storage devices, they are governed by their inductance and the DC current being applied. Prior art devices using ferrite cores only allow for small amounts of energy to be stored within the component before the ferrite material magnetically saturates. It is noted that ferrite has been developed and applied primarily in AC applications, e.g. transformers). To improve the energy storage capability, an air-gap is introduced into the core shape, typically on the center leg (or around the periphery of a toroid core), where the energy is stored in the form of DC magnetic flux. When the DC magnetic flux becomes sufficiently large, the inductor will again be seen to saturate and cease to have an inductive character. Hence, the ferrite core operates primarily as a path for the flux to enter the air-gap.

Because the ferrite provides a path (or short-circuit) to the gap, it is possible to form part of the path by using the core of another inductor. Advantageously, the stacking approach of the present invention takes advantage of this feature, in effect using each successive core piece in the stack as part of the induction path for the prior inductor. At least two separate gaps (for 2 inductors) are required for this approach, and the gaps of the respective devices must not significantly interact. By using the "backplate" core piece of a first device to form the return path for the flux of the coil of a second device, such operation and separation is possible.

As shown in FIG. 2*a*, the first, second, and third core elements 206, 208, 210 are substantially identical in form, the latter two elements being disposed in a face-to-face (symmetric) configuration with each other. This approach advantageously allows for the device 200 to be made using three identical core pieces if desired, thereby reducing the cost and labor associated with forming heterogeneous pieces.

It is also noted that the core pieces have no chirality or "handedness" form the standpoint that any of the three core pieces can be used in place of the others, and in effectively any orientation. Hence, there is no "up/down" or "left/right" distinction between the core pieces. This greatly simplifies assembly since the core components (and even the winding elements) can be assembled in multiple orientations.

The core elements each include a central spindle 209 around which the windings are disposed; depending on the configuration and electrical properties desired, the height of this spindle (i.e., how far it extends in height along its central axis 207) can be controlled for each element. This allows for adjustment of the gap formed between the face of the spindle element and the other core element to which it is mated. For example, in the aforementioned "face-to face" disposition, the height of the two facing spindle elements 209 of the respective core elements can be adjusted so as to allow the gap between the spindle faces to range from zero to any desired amount (within the capacity of the selected core elements). Alternatively, in the face-to-back orientation (see the relationship between core elements 206, 208 in FIG. 2*a*), the size of the gap can be controlled by the height of the one spindle element 209, e.g., associated with core element 206 in FIG. 2*a*.

It will also be recognized that the core element geometry relative to the diameter of the windings may be varied. As shown in FIG. 2*a*, the winding height may exceed the profile of one or more dimensions of the core elements, such as where the device 200 is surface mounted with the exposed windings oriented upward (away from the PCB or substrate). Such effect can be achieved by offsetting the center leg of each core sufficiently to accommodate the winding within the profile of the core elements on one side (i.e., the PCB side), while allowing the other side of the winding element(s) to protrude over the top of the core elements. Hence, the core elements can advantageously be shaped in literally any configuration relative to the winding element dimensions.

Figure 3B:
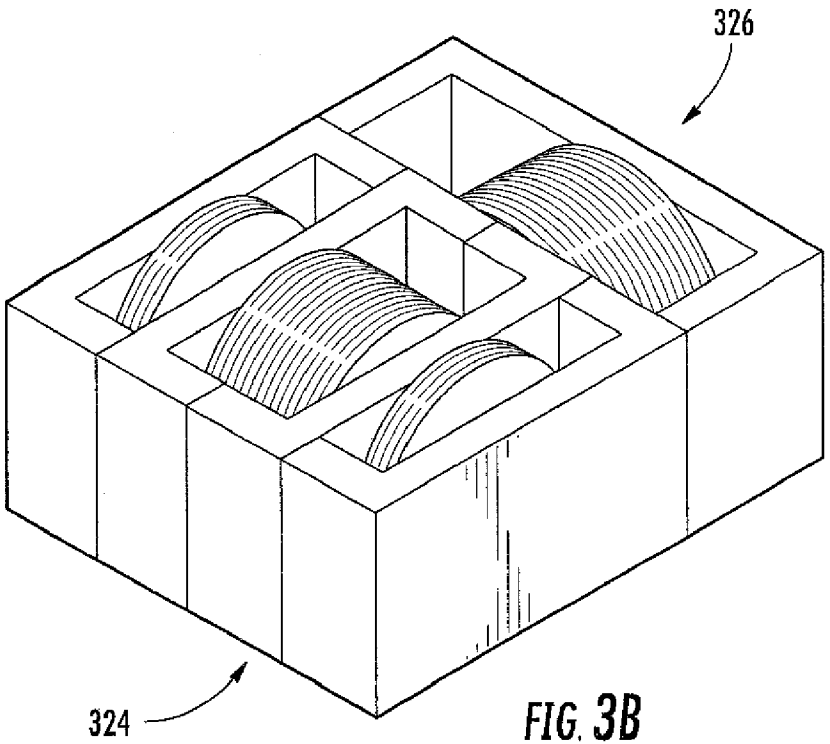
FIGS. 3*a* and 3*b* comprise assembled perspective views of a still other embodiments of the stacked inductive device of the invention.
Figure 3A:
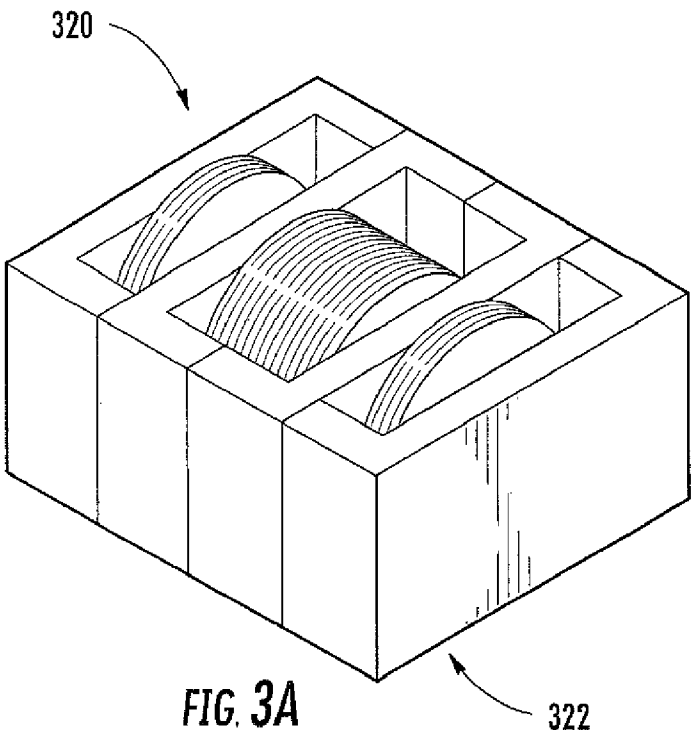

Furthermore, the stacking approach of the invention allows for effectively infinite extension of the number of inductors of the device; i.e., a third winding element and fourth core element (see FIG. 3*a*) can be disposed on either side 320, 322 of the device 200 of FIG. 2*a*, and so forth. As illustrated in FIG. 3*b*, the addition of more inductive devices can also occur on the front and/or back faces 324, 326 of the inductive device 200, or even on the top and bottom faces (not shown). Completion of the magnetic flux path through one or more core pieces of another inductive device can therefore be achieved using any number of different geometries, the embodiments of FIGS. 2*a*-3*b* therefore being only illustrative of the broader concepts.

It will also be recognized that methods of precisely controlling the electrical and magnetic performance of the inductive devices disclosed herein may be used, including control of the gap thickness and properties, as well as the placement of the gap relative to other components within the device.

The stacked device 200 disclosed herein (as well as other embodiments) may advantageously be used with most any kind of termination header or structure, or without one as well. For example, a molded plastic header of the type well known in the art (not shown) adapted to receive at least a portion of the device can be used, wherein conductive terminals on or within the header can be used to interface to the pads on a PCB or other external device, as well as to the inductor windings (elements) described above. An exemplary header or termination element includes a plurality (e.g., eight) terminals. These terminals may be of literally any configuration, including for example, substantially rectangular cross-section adapted for surface mount (SMT), circular or elliptical cross-section for through-hole mounting, ball-grid array, etc. They may also be notched or shaped to facilitate wire wrapping if desired. Furthermore, it will be appreciated that the header may comprise a self-leaded arrangement (not shown) of the type described in co-owned U.S. Pat. No. 5,212,345 to Gutierrez issued May 18, 1993 entitled "Self leaded surface mounted coplanar header", or U.S. Pat. No. 5,309,130 to Lint issued May 3, 1994 and entitled "Self leaded surface mount coil lead form", both of which are incorporated herein by reference in their entirety. For example, in one embodiment, the header is a molded polymer device having eight (8) self-leading terminals formed therein, upon which various of the conductors of the winding elements 202, 204 are wound.

It is further recognized that the header may take any number of different forms or configurations in terms of its shape, including substantially square, circular, or polygonal form, depending on the needs of the particular application. Additionally, the exact placement of the terminals within the element header can be optimized based upon circuit placement and mounting considerations at the system level.

In another variant, the conductive terminals can be bonded directly to the core elements 206, 208, 210 such as with an insulating compound such as a silicone rubber encapsulant, or electronics epoxy. This approach obviates the cost and space associated with the header.

The stacking approach of the invention may also be applied to "low profile" technologies such as, for example, that described in U.S. patent application Ser. No. 10/885,868 filed Jul. 6, 2004 previously incorporated herein. Specifically, the aforementioned protrusion of the winding elements may be made to face the PCB or substrate to which the device 200 is mounted, and cooperating with an aperture or recess formed in that PCB or substrate. The leads of the device 200 may be routed on the same side of the PCB as to which the device is mounted, or alternatively may be routed through the aperture and terminated on the other side of the PCB.

FIG. 2*b* illustrates an EP-type core embodiment of the inductive device, wherein three winding elements 252, 254, and 255 are used in conjunction with four core elements 256, 258, 260, 261. Here, two of the three winding elements are homogeneous, although it will be appreciated that other variations may be substituted. Advantageously, however, the four core elements 256, 258, 260, 261 of the embodiment of FIG. 2*a* are substantially identical in order to leverage the use of one core component configuration only, although this is not a requirement.

It will be appreciated from the foregoing that the benefits of the present invention include, inter alia, (i) reduction in overall size of the device as compared to traditional or prior art core configurations, and a higher density of components; (ii) identical core element(s) can be used for all device configurations if desired, thereby allowing higher volume ordering and hence cost reduction; (iii) a degree of self-shielding afforded by the stacked configuration so that cross-talk between the winding elements is mitigated, unlike gapped toroid technology; (iv) the stacked approach can be utilized with nearly all standard or non-standard core shapes, and hence is largely core-shape; (v) different core types and component configurations can be mixed together (with proper adaptation to ensure that the various magnetic paths created within the composite device are compatible and the desired electrical performance is maintained).

It is noted that the benefit in size reduction can be quite significant when the stacking arrangement of the present invention is coupled with the self-bonded winding arrangement of U.S. Ser. No. 10/885,868 filed Jul. 6, 2004 previously incorporated herein. However, even when the stacking arrangement is used with a bobbin or spool-based design, a smaller size results as compared to the prior art.

The inductive device of the present invention finds use in any number of different applications where two or more inductors are required (especially those where surface mount footprint and/or overall device volume are limited or critical). One such exemplary application comprises DSL splitters, wherein multiple lightweight and compact yet high-performance inductors are desired.

Method of Manufacturing

Figure 4:
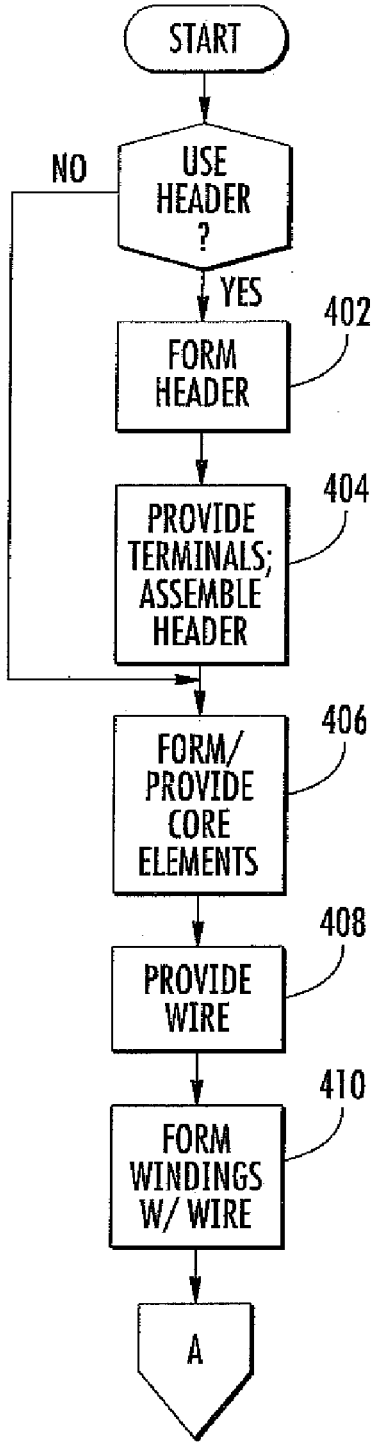
FIG. 4 is a logical flow diagram illustrating one exemplary method of manufacturing the device(s) of FIGS. 1-3.
Figure 4:
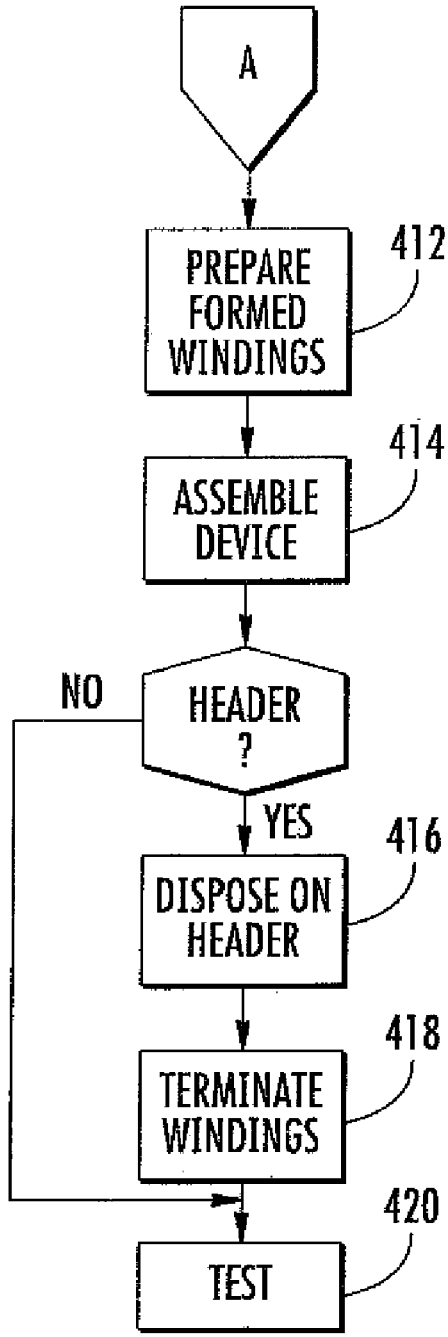

FIG. 4 illustrates one exemplary method 400 of manufacturing the inductive device of FIGS. 2*a*-3*b*. It will be appreciated that while various steps are described in terms of forming or manufacturing components of the inductive device 200, such steps may be obviated by alternatively procuring the pre-manufactured component from a third party.

Furthermore, while cast in terms of the device 200 of FIG. 2*a*, the method described herein is readily adapted to other variants and embodiments of the stacked device of the invention.

As shown in FIG. 4, the method 400 Generally comprises first forming a termination header if required (step 402), including forming the terminals and disposing them within the header (step 404). Next, the core elements 206, 208, 210 are provided (step 406). Bonded wire is next provided in sufficient quantity (step 408). Per step 410, the bonded wire is then formed on an external form, and cured (e.g., heated, exposed to chemical agents, irradiated, etc.). The cured winding element is then removed from the form and prepared, which includes properly positioning the free ends of the windings and stripping them if required (step 412). The prepared coils are then disposed between the respective three core elements, the latter being optionally bonded together with adhesive or epoxy if desired (step 414). The assembled core is then disposed onto the termination header (if used) using adhesive (step 416), and the free ends of the windings terminated to their respective terminals (step 418). The device is then optionally tested per step 420.

Furthermore, the methods of manufacturing (and process/component control and selection during manufacturing described in co-pending and co-owned U.S. application Ser. No. 10/000,877 filed Nov. 14, 2001 entitled "Controlled Induction Device and Method of Manufacturing" which is incorporated herein by reference in its entirety may be used in conjunction with the present invention if desired in order to further control electrical performance.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An inductive device, comprising:

a plurality of winding elements, at least a portion of which are comprised of bonded wire; and at least three magnetically permeable core elements, wherein said magnetically permeable core elements are disposed in a substantially co-axial and coplanar arrangement with respect to an external substrate to which the inductive device is mounted, said core elements collectively forming a plurality of coplanar apertures having a plurality of winding ends associated with said plurality of winding elements passing there through, said at least three magnetically permeable core elements being of substantially identical shape and mated to one another;

wherein said mating produces respective cavities formed by said substantially co-axial and coplanar magnetically permeable core elements that accommodate said winding elements and have different sizes.

2. The inductive device of claim 1, wherein said at least three magnetically permeable core elements are substantially identical in size.

3. The inductive device of claim 2, wherein at least two of said at least three core elements comprise central core spindles, and are mated in face-to-face orientation such that such core spindles are substantially aligned along a central axis thereof.

4. The inductive device of claim 1, wherein each of said plurality of winding elements comprises a bonded multi-turn winding with a parylene coating, adapted to provide a minimum level of electrical isolation between individual ones of said turns.

5. The inductive device of claim 1, wherein said at least three magnetically permeable core elements are substantially achiral to one another in three dimensions.

6. An inductive device, comprising:

a plurality of bonded wire windings that each define a longitudinal winding axis; and at least three magnetically permeable core elements disposed adjacent to one another, at least one of said three elements being in both a front-to-front and a front-to-back disposition with others of said three elements, each of said core elements comprising a central core portion;

wherein said magnetically permeable core elements are each substantially identical in shape and are disposed in a substantially co-axial arrangement with respect to said longitudinal winding axis, said core elements also arranged in a coplanar arrangement with respect to an external substrate to which the inductive device is to be mounted; and wherein said at least three core elements disposed adjacent to one another create at least two cavities of different sizes, said at least two cavities receiving at least a portion of respective ones of said wire windings.

7. The inductive device of claim 6, wherein said at least three magnetically permeable core elements are substantially identical in size.

8. The inductive device of claim 7, wherein each of said plurality of bonded wire windings comprises a bonded multi-turn winding with a dielectric coating, said dielectric coating providing a minimum level of electrical isolation between turns of said multi-turn winding.

9. The inductive device of claim 8, wherein said at least three magnetically permeable core elements are substantially achiral to one another in three dimensions.

10. An inductive device electronics assembly, comprising:

a printed circuit board comprised of a digital subscriber line (DSL) circuit that includes a plurality of inductive devices, each of said inductive devices comprising:

a plurality of winding elements, at least a portion of which are comprised of bonded wire; and at least three magnetically permeable core elements, wherein said magnetically permeable core elements are disposed in a substantially co-axial and coplanar arrangement with respect to an external substrate to which the inductive device is mounted, said core elements collectively forming a plurality of coplanar apertures having a plurality of winding ends associated with said plurality of winding elements passing there through, said at least three magnetically permeable core elements each comprising a substantially identical shape and mated to one another in both a front-to-front and a front-to-back disposition;

wherein said front-to-front and said front-to-back disposition varies the size of said respective cavities formed by said substantially co-axial and coplanar magnetically permeable core elements that accommodate said winding elements; and wherein said inductive devices make the overall size of said electronics assembly smaller than would be possible with an inductive device design that includes bobbins for each of its winding elements.

11. The assembly of claim 10, wherein said DSL circuit comprises a DSL splitter circuit for use in telecommunications equipment.

12. The assembly of claim 10, wherein said at least three magnetically permeable core elements are substantially identical in size.

13. The assembly of claim 12, wherein at least two of said at least three core elements comprise central core spindles that are disposed in a face-to-face orientation such that said core spindles are substantially aligned along a central axis thereof.

14. The assembly of claim 10, wherein each of said plurality of winding elements comprises a bonded multi-turn winding with a dielectric coating applied thereto, said coating providing an increased level of electrical isolation between said turns.

15. The assembly of claim 10, wherein said at least three magnetically permeable core elements are substantially achiral to one another in three dimensions.

16. An inductive device electronics assembly, comprising:

a printed circuit board comprised of a digital subscriber line (DSL) circuit that includes a plurality of inductive devices, each of said inductive devices comprising:

a plurality of bonded wire windings that each define a longitudinal winding axis; and at least three magnetically permeable core elements disposed adjacent to one another in mixed front-to-front and front-to-back dispositions, each of said core elements, comprising:

a central core portion;

an outer core portion; and a cavity for accommodating one or more of said bonded wire windings, said cavity disposed between said central core portion and said outer core portion;

wherein said magnetically permeable core elements are each substantially identical in shape and are disposed in a substantially co-axial arrangement with respect to said longitudinal winding axis, said core elements also arranged in a coplanar arrangement with respect to an external substrate to which the inductive device is to be mounted; and wherein said front-to-front and front-to-back dispositions vary the size of said respective cavities formed by said substantially co-axial and coplanar magnetically permeable core elements that accommodate said winding elements.

17. The assembly of claim 16, wherein said at least three magnetically permeable core elements are substantially identical in size.

18. The assembly of claim 17, wherein each of said plurality of bonded wire windings comprises a bonded multi-turn winding with a dielectric coating, said dielectric coating providing a minimum level of electrical isolation between turns of said multi-turn winding.

19. The assembly of claim 18, wherein said at least three magnetically permeable core elements are substantially achiral to one another in three dimensions.

20. The assembly of claim 16, wherein said inductive devices make the overall size of said electronics assembly smaller than would be possible with a bobbin containing inductive device design.

* * * * *